US005299608A

United States Patent [19]

Bosyj

[11] Patent Number: 5,299,608

[45] Date of Patent: Apr. 5, 1994

[54] SEALED COUPLING FOR A FLUID CONTAINER

[75] Inventor: Nick M. Bosyj, North Canton, Ohio

[73] Assignee: The Hoover Company, North Canton, Ohio

[21] Appl. No.: 84,354

[22] Filed: Jun. 28, 1993

Related U.S. Application Data

[63] Continuation of Ser. No. 851,318, Mar. 16, 1992, abandoned.

[51] Int. Cl.[5] ..... B67C 9/00

[52] U.S. Cl. ..... 141/285; 141/21; 141/67; 141/309; 141/384; 222/400.7; 15/320; 215/309; 215/329; 137/212

[58] Field of Search ..... 141/2, 18, 21, 67, 285, 141/286, 290, 307, 310, 325, 363, 365, 383, 384; 222/325, 399, 400.5, 400.7, 400.8; 220/374; 215/222, 309, 329; 285/7, 137.1, 319, 921; 137/212

[56] References Cited

U.S. PATENT DOCUMENTS

| | | | |
|---|---|---|---|
| 793,869 | 5/1905 | Anderson . | |
| 1,021,203 | 3/1912 | Matchette . | |
| 1,583,528 | 5/1926 | Clements . | |
| 1,799,433 | 4/1931 | Murphy . | |
| 2,591,531 | 4/1952 | Fishback | 285/175 |
| 2,660,457 | 11/1953 | Mallon | 285/175 |
| 3,147,512 | 9/1964 | Gleason | 15/566 |
| 3,184,782 | 5/1965 | Armour | 15/594 |
| 3,443,726 | 5/1969 | Muller et al. | 222/80 |
| 3,685,694 | 8/1972 | Ianelli | 222/82 |
| 3,805,425 | 4/1974 | Spoida et al. | 38/69 |
| 3,874,024 | 4/1975 | Ford | 15/339 |
| 4,146,288 | 3/1979 | Ramsay et al. | 339/90 |
| 4,333,203 | 6/1982 | Yonkers | 15/321 |
| 4,676,287 | 6/1987 | Fitzwater | 141/285 |
| 5,108,015 | 4/1992 | Rauworth et al. | 222/400.7 |

*Primary Examiner*—J. Casimer Jacyna

[57] ABSTRACT

A coupling arrangement connects a container of concentrated cleaning fluid to a dispensing apparatus in a carpet cleaning machine. To facilitate the required fluid connection, the container is fitted with a plug having one port at its center and a second port radially disposed from the center port and positioned within an annular groove concentric with the center port. The distance from the center port to the second port in the plug is equal to the distance between corresponding central and radial ports in the dispenser. When the container is rotated to engage the dispenser and advance it into position, the center port of the plug and central port of the dispenser align since they are on the same axis. The radial port of the dispenser is aligned with the annular groove in the plug, enabling fluid communication with the second port in the plug irrespective of the rotational orientation.

10 Claims, 5 Drawing Sheets

SEALED COUPLING FOR A FLUID CONTAINER

RELATED APPLICATIONS

This application is a continuation of application Ser. No. 07/851,318, filed Mar. 16, 1992, and now abandoned, and owned by a common assignee.

BACKGROUND OF THE INVENTION

1. Field of the Invention

The present invention relates generally to carpet cleaning machines and, more specifically, to an associated coupling arrangement for providing a fluid tight connection with a disposable container of concentrated cleaning solution.

2. Description of Related Art

Carpet cleaning machines, often referred to as extractors, are used to perform a "wet" cleaning process. Generally, they apply a water based cleaning solution to the carpet; as a result, dirt is washed away from the carpet fibers and becomes suspended in the cleaning solution. The solution and suspended dirt are then removed from the carpet by a vacuum apparatus in the extractor. The cleaning solution used in these machines is generally a mixture of hot water and a concentrated cleaning fluid. In prior art extractors, it is often necessary for the user to premix a quantity of the concentrate with water and fill a tank or other chamber of the extractor with the dilute solution. This procedure can result in poor cleaning performance or even damage to the carpet if the user does not follow the mixing instructions carefully.

An alternate approach for supplying a properly mixed solution has been to provide means within the extractor to dispense the proper dosage of concentrate and mix it with water from a separate container within the machine in preparation for application to the carpet. Although this approach is simpler for the user and has the potential for more accurate solution mixing, prior art devices have not been entirely successful in its implementation. One drawback relates to the need for the cleaning concentrate container to be disposable, so that the desired user convenience is achieved. Prior art containers have had a complex construction with multiple parts, making them more expensive and increasing the cost to the consumer. In addition, there are problems associated with attaching the container to the machine that make it difficult to create a fluid tight seal and achieve the proper connection with the associated ports in the dispensing apparatus of the extractor. Improper alignment of the ports, as shown in some prior art devices, results in leakage and/or improper mixing of the concentrate with the water, causing the performance of the extractor to be unsatisfactory.

SUMMARY OF THE INVENTION

Accordingly, an object of the present invention is to provide a coupling arrangement in a carpet cleaning machine in which a container of concentrated cleaning solution can be easily connected and consistently provide proper fluid communication with the ports of an associated dispensing apparatus.

Easy connection of the fluid container is accomplished by providing arcuate channels in the cylindrical neck of the container which engage diametrically opposed lugs in the dispenser housing. When the user aligns the channels with the lugs and rotates the container, the lugs slide in the channels and advance the container to its proper, sealed position in the housing.

Fluid connection of the container with the dispensing apparatus involves alignment of two ports in the container with corresponding ports in the dispenser housing Specifically, the container has one port at the center of a plug fitted in the end of its cylindrical neck which aligns readily with a central port in the dispenser housing. A second port in the plug is radially disposed from the central port and positioned within an annular groove, the groove being concentric with the central port. The distance between the central port and the second port in the plug is equal to the distance between the corresponding central port and second port in the dispenser housing.

Given this unique construction, proper communication between the ports in the plug of the container and dispenser housing is consistently established when the container is rotated and advanced into position. Specifically, the central ports align readily since they are on a common axis of rotation; the second port of the dispenser housing will always be disposed above the annular groove in the container thus establishing a flow path with the second port in the container. Thus, the required fluid communication is established regardless of the rotational orientation of the plug with respect to the container or dispenser housing.

DESCRIPTION OF THE PREFERRED EMBODIMENT

Figure 1:
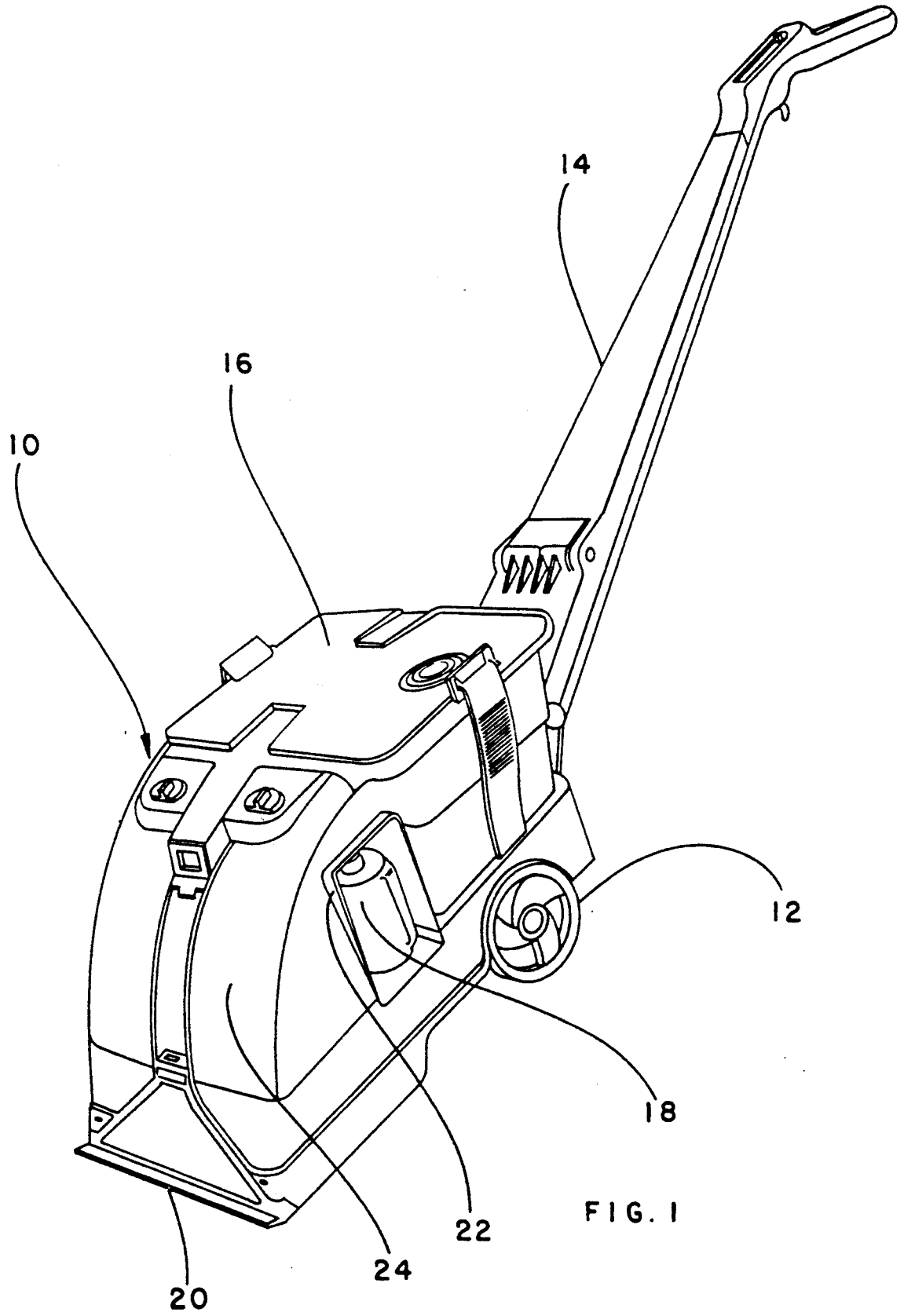
FIG. 1 is a perspective view of a carpet cleaning machine having a dispensing apparatus according to the present invention.

Referring to FIG. 1, there is illustrated a machine for wet cleaning carpets, identified herein as a domestic extractor 10. The extractor 10 is equipped with wheels 12 and a handle 14 to allow the user to maneuver the unit over a carpet to be cleaned. In order to provide its cleaning function, the extractor 10 is provided with a tank 16 to store a supply of clean water, a container 18 of concentrated cleaning solution, spray means (not shown) to wet the carpet with an appropriate mixture of the water and cleaning concentrate, and a nozzle 20 to withdraw the soiled solution from the carpet by means of a suction force created by an internal motor/fan unit (not shown). The solution withdrawn through the nozzle 20 is conveyed to tank 16 and separated from the suction air flow in a conventional manner; the dirty solution is retained separately from the clean water supply in tank 16. Preferably, tank 16 is easily removable from the extractor 10 to facilitate its filling with clean water or emptying the soiled detergent solution.

Figure 2:
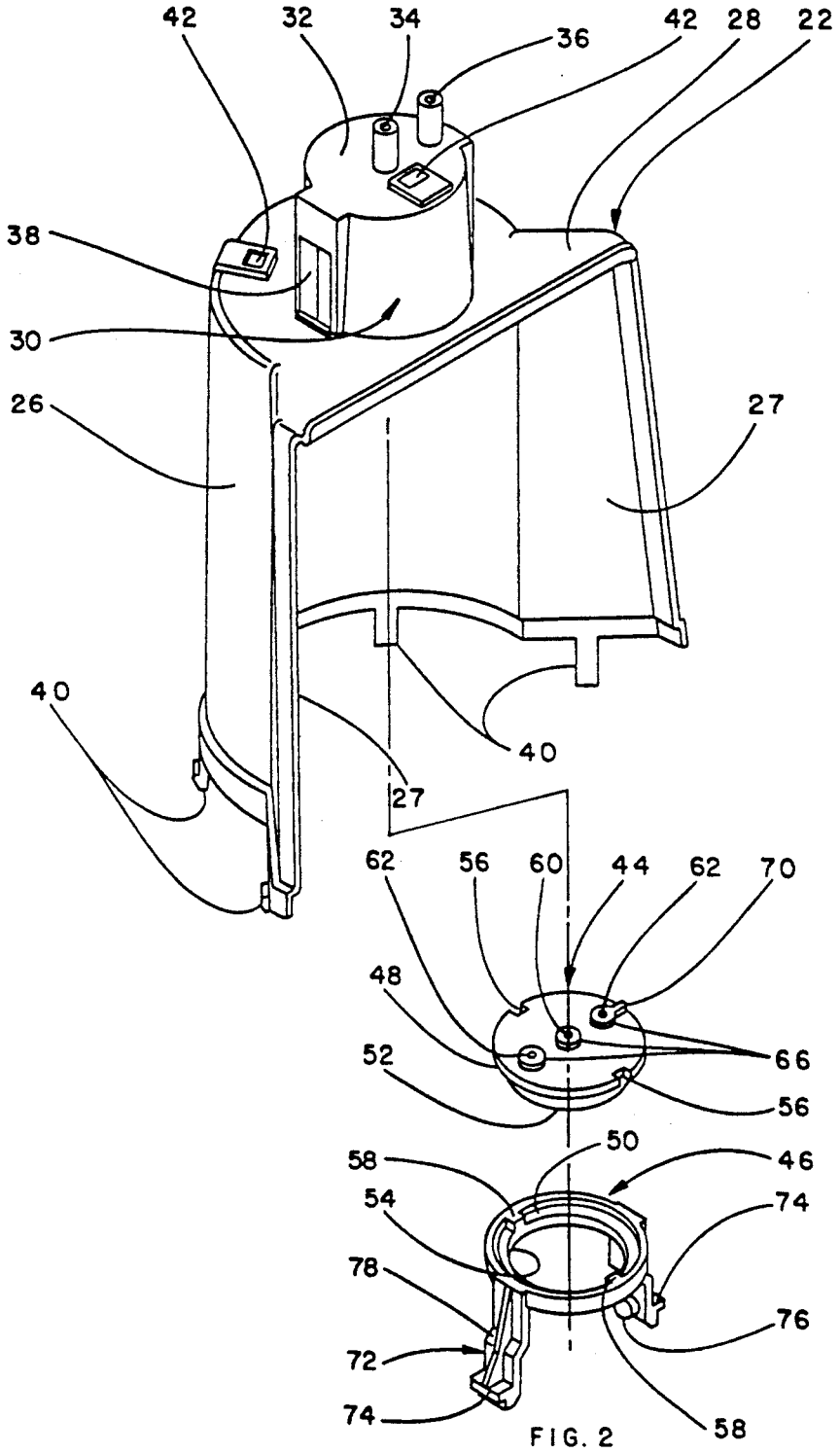
FIG. 2 is an exploded perspective view showing the dispenser housing, resilient seal and seal retainer as taught by the present invention.

To provide means for connection and support for the container 18, there is provided a recessed housing 22 in the side of extractor 10. The structure of housing 22 is largely concealed by a hood or cover 24; accordingly, the details of this element are more clearly shown in FIG. 2. The body of housing 22 is configured to provide a generally rectangular, open front, an arcuate rear wall 26, and angled side walls 27 which serve to provide a recess for container 18. Housing 22 also has an upper wall 28 with a generally cylindrical extension 30, sized to receive the end of container 18, as will be more fully described later. The upper end 32 of extension 30 provides a relatively flat sealing surface and is provided with ports 34 and 36, preferably in the form of tubular extensions to facilitate connection with dispensing apparatus (not shown) within the extractor 10. Note that port 34 is positioned at the center of the cylindrical extension 30. The extension 30 is also provided with diametrically opposed, rectangular notches 38, the purpose of which will be explained in the following paragraphs. Finally, the housing 22 is provided with a series of extension tabs 40 and notches 42 to facilitate attachment of housing 22 with other structural elements of extractor 10.

Adapted for mounting within the cylindrical extension 30 of housing 22 are a resilient seal 44 and a seal retainer 46. (The interaction of elements of the housing 22, seal 44 and retainer 46 are shown with additional detail in FIG. 6.) The body of the resilient seal 44 is a short, almost flat, double diameter cylinder. The larger diameter 48 is sized to fit snugly within a circular recess 50 of the retainer 46. The smaller diameter 52 of the seal 44 depends downwardly so that it will pass through a circular opening 54 formed by the body of retainer 46. The larger diameter 48 of the seal 44 is also provided with diametrically opposed, rectangular notches 56 which engage appropriately positioned keys 58 in the recess 50 of retainer 46. Engagement of the notches 56 by the keys 58 will prevent the seal 44 from rotating with respect to the retainer 46.

The seal 44 has a center aperture 60 and two outer apertures 62. These apertures are spaced apart a distance corresponding to the spacing of ports 34 and 36 in extension 30 of the housing 22; specifically, the distance between center aperture 60 and either outer aperture 62 is equal to the distance between ports 34 and 36. The apertures 60 and 62 all have raised perimeters 66 that are received by corresponding recesses 68 in the extension 30 of housing 22 (see FIG. 6). This limited area of contact between the seal 44 and the housing 22 provides for more effective sealing against the ports 34 and 36. It should be noted that the raised perimeter 66 of one of the outer apertures 62 has a radial portion 70 which extends to the edge of the larger diameter 48. The portion 70 is provided, as required, to facilitate the manufacture of the seal 44 by injection molding.

The retainer 46 is provided with diametrically opposed, downwardly depending legs 72. Each leg 72 is provided with an outwardly extending tab 74 and a cylindrical lug 76 pointing inwardly. The tab 74 is configured to engage the edge of the rectangular notch 38 near the upper wall 28 of the housing 22. Note also that the legs 74 are provided with an offset 78 so that the retainer may be more easily positioned in the cylindrical extension 30 of housing 22.

Given the configurations as described previously, the resilient seal 44 and seal retainer 46 are easily assembled to the housing 22. The seal 44 is placed in the retainer 46 so that its larger diameter 48 nests within the circular recess 50, with the notches 56 engaged by the keys 58. The seal 44 and retainer 46 are then inserted into the cylindrical extension 30 of the housing 22. The legs 72 of the retainer 46 are sufficiently flexible so that the tabs 74 deflect inwardly and then snap back outwardly to engage the notch 38 and position the seal 44 snugly against the upper end 32 of the cylindrical extension 30. It will be observed that the extra outer aperture 62 (only one is necessary) in the seal 44 is provided to facilitate assembly; it insures a proper sealing surface for port 36 despite the fact that the retainer 46 can be installed within the extension 30 in alternate positions 180° apart (relative to the central axis). The seal 44 as held in position by the retainer 46 thus provides a suitable resilient interface between the ports 34 and 36 of housing 22 and the container 18, as will be described in greater detail in the following paragraphs.

Figure 3:
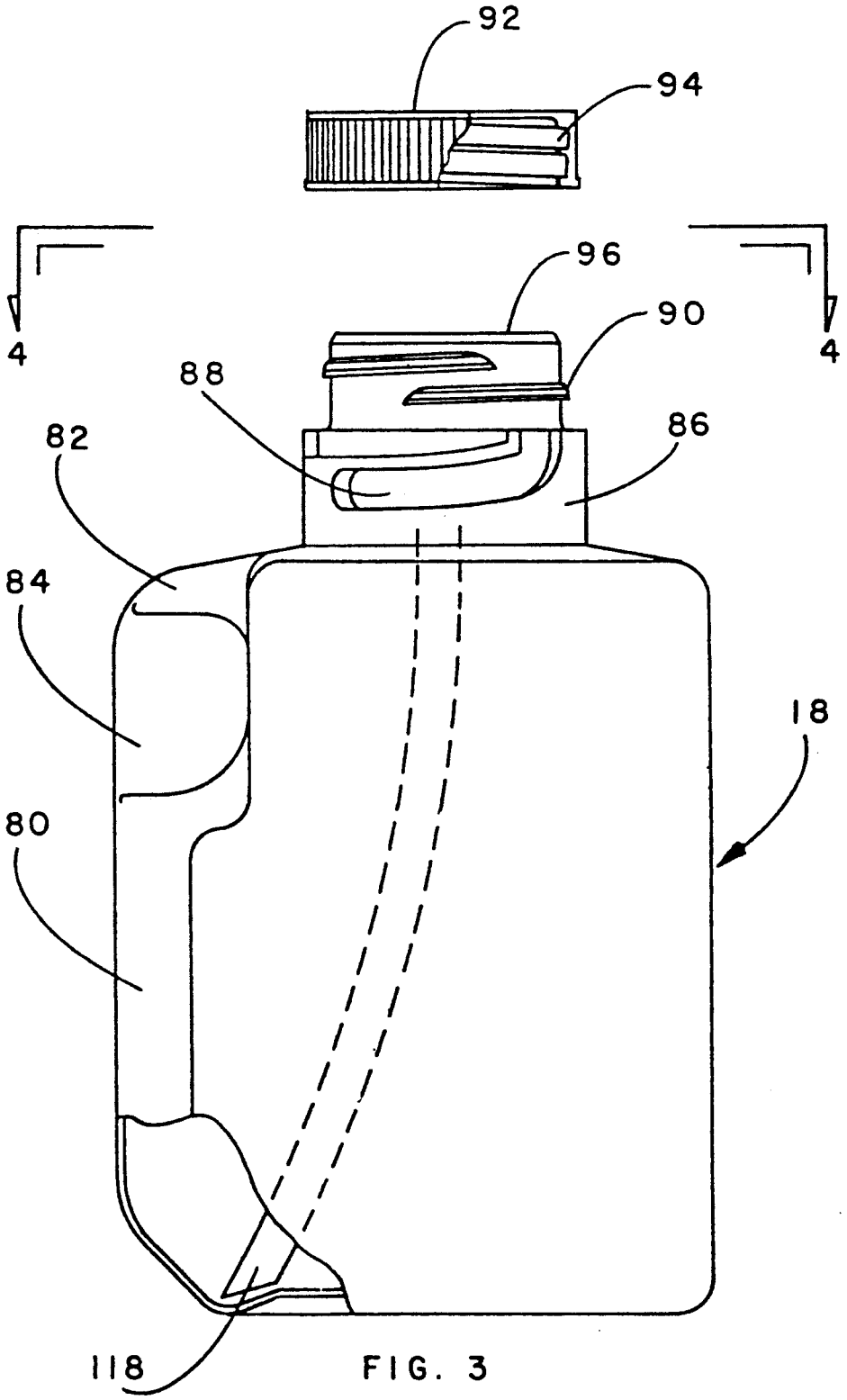
FIG. 3 is a side elevational view, with parts broken away, of a fluid container as taught by the present invention.
Figure 4:
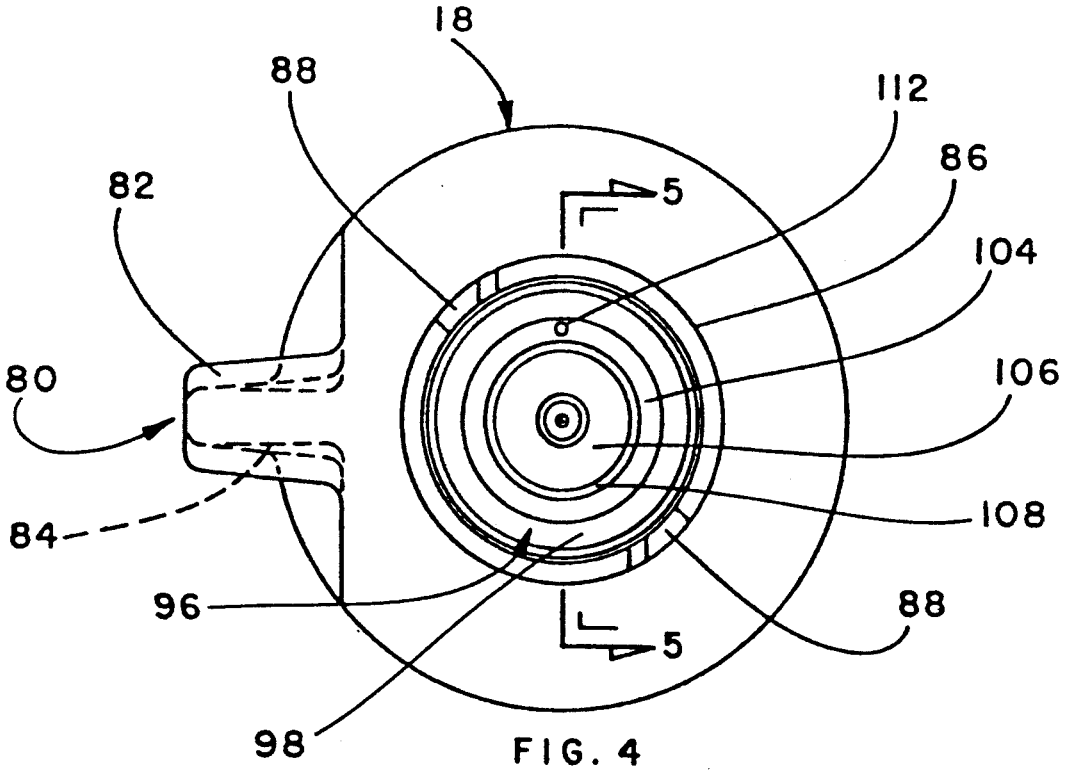
FIG. 4 is a plan view of the fluid container shown in FIG. 3 taken along line 4—4.

As shown in FIG. 3 and FIG. 4, the container 18 preferably has a generally cylindrical shape with an integral handle 80. The handle 80 has a widened portion 82 near the top of the container 18 with an adjacent recessed area 84 to facilitate handling by the user preferably, the container 18 is blow-molded from an appropriate plastic material so that the handle 80 can be easily integrated with the body of container 18. It is contemplated that a reasonable capacity for the container 18 is a volume of 16 fluid ounces of concentrated cleaning solution.

The container 18 is provided with a cylindrical neck 86 specifically designed for engagement with the housing assembly as previously described. In particular, neck 86 is provided with diametrically opposed, arcuate channels 88 having a vertical segment leading to a downwardly sloping transverse segment. (The manner of interaction between the channels 88 and the cylindrical lugs 76 on retainer 46 will be discussed in detail in a subsequent paragraph.) Note that the neck 86 is also provided with a threaded portion 90 to enable attachment of a cap 92 having corresponding internal threads 94.

Figure 5:
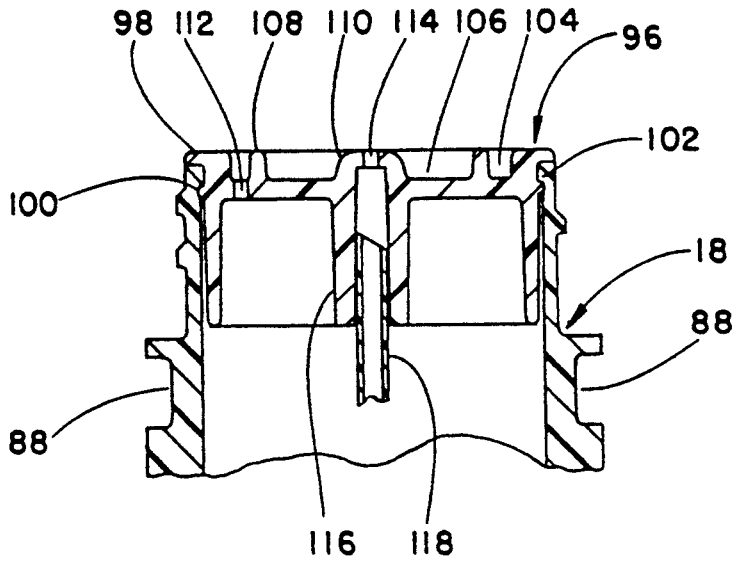
FIG. 5 is a fragmentary cross sectional view of the fluid container taken along line 5—5 of FIG. 4.

As clearly shown in the sectional view of FIG. 5, the neck 86 of container 18 is sized to receive a cylindrical plug 96. The outer diameter of the plug 96 is enlarged locally to provide a lip 98 that prevents the plug from falling into the container 18, and a bead 100 which passes over a narrowed portion 102 in the neck 86 to provide a "snap" engagement between the plug 96 and the neck 86 of container 18.

The surface of the plug above the neck 86 is specially configured to enhance the sealing properties of the assembly. A narrow groove 104 is provided near the outer perimeter and a wider groove 106 provides a circular recess near the center of the plug 96. This geometry provides for improved sealing properties of the plug in the area of the lip 98 and the raised area portions 108 and 110 created by the grooves 104 and 106. Obviously, to create an effective seal, the outermost surface of lip 98 as well as the raised portions 108 and 110 should define a planar surface, as shown by the cross sectional view in FIG. 5.

Means for fluid communication from the container 18 is provided by aperture 112 disposed within groove 104, aperture 114 disposed in the central raised portion 110, a tubular extension 116 of the plug 96 extending below aperture 114 and a supply tube 118 received by the extension 116 and extending to the bottom of container 18 (see FIG. 3).

To prepare the extractor 10 for operation, the user would normally begin by adding hot, clean water to the appropriate compartment in tank 16. The cleaning solution is then provided in concentrated form as the contents of container 18. The user of the extractor 10 simply removes the cap 92, aligns the vertical segment of the channels 88 with the cylindrical lugs 76 located within the housing 22. The user lifts upward slightly (toward the seal 44) and rotates the container 18 counterclockwise. As the container 18 is rotated, the channels 88 ride along the lugs 76, advancing the plug 96 tightly against the seal 44 which is also sealed against the upper wall 32 of the housing. The container 18 is most effectively sealed when it has been rotated sufficiently so that its travel has been stopped by the lugs 76 reaching the end of channels 88.

Figure 6:
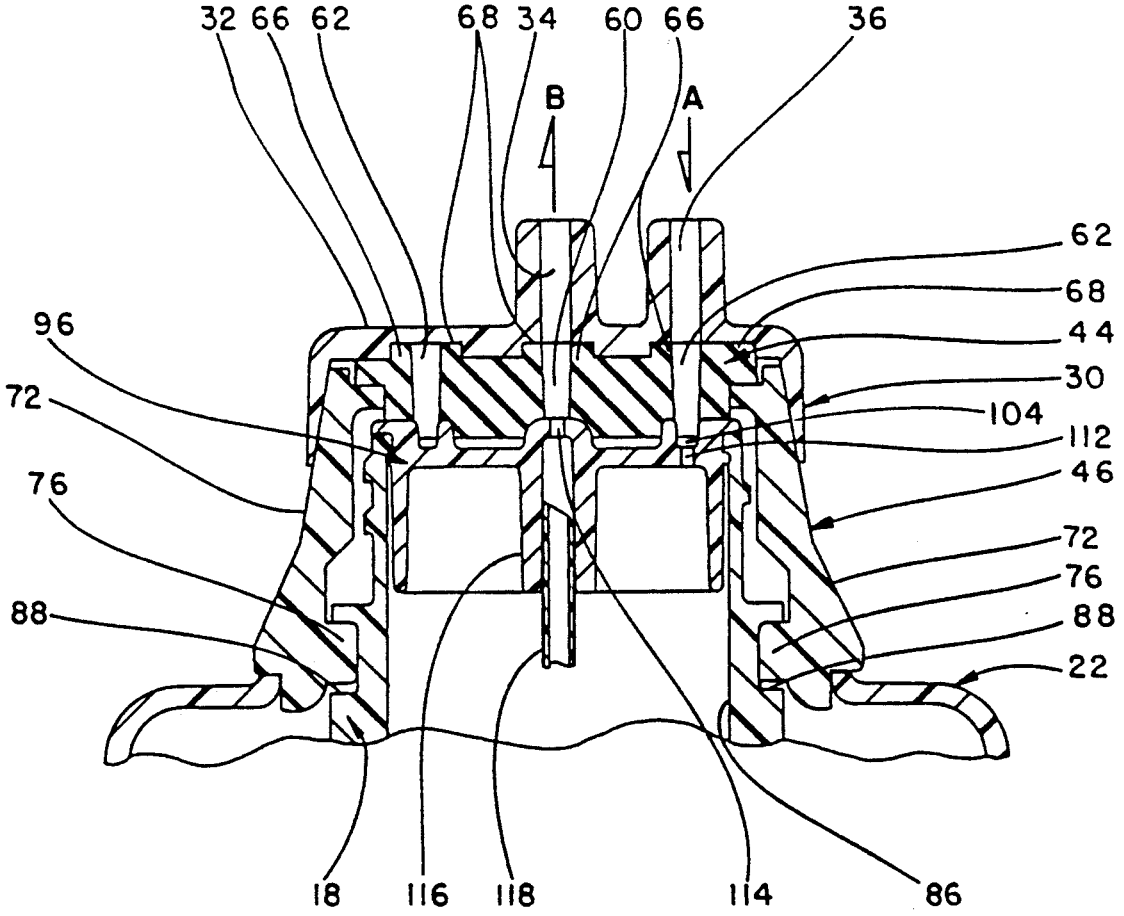
FIG. 6 is a fragmentary cross sectional view of the fluid container engaged by the dispenser housing, creating a fluid tight seal.

The fluid communication path between the various elements is best seen in the cross sectional view of FIG. 6. Note the alignment of port 34 with the center aperture 60 of seal 44 which aligns with aperture 114 in the plug 96. Similarly, port 36 aligns with one of the outer apertures 62 (depending on the orientation of the seal) which is in alignment with the groove 104. Since aperture 112 is disposed within the groove 104, full communication is established between the interior of the container 18 and the port 36. Note that aperture 112 would not necessarily lie directly below outer aperture 62 as shown in FIG. 6; its specific orientation with respect to aperture 62 is inconsequential.

During operation of the extractor 10, the interior of container 18 is pressurized slightly by connecting a source of pressurized air to the port 36, as represented by arrow A. This creates internal pressure which forces the concentrated cleaning solution up through the tube 118, through aperture 114 of the plug, through center aperture 60 of seal 44 and out of port 34 of the housing 22, as represented by arrow B. The concentrated solution is then mixed proportionately with the clean water supply from tank 16 and sprayed on the carpet in preparation for extraction.

While the preceding description pertains to a preferred embodiment of the present invention, it should be apparent to persons skilled in the art that many modifications can be made without departing from the true spirit and scope of the invention. Accordingly, it is intended that all matter contained in the above description, as shown in the accompanying drawings, shall be interpreted as illustrative and not in a limiting sense.

What is claimed is:

1. A coupling arrangement comprising:

a) a housing having a sealing surface, b) first and second ports in the sealing surface of the housing, c) a fluid container having a cylindrical neck with an open end, d) a cylindrical plug disposed in the open end of the neck of the container, an end wall of the plug having a central port aligned with the central axis of the plug and a radial port spaced from the central port a distance equal to the distance between the first and second ports in the housing, the radial port also being disposed within an annular groove in the end wall, and e) means for engaging and advancing the container within the housing when the container is placed in the housing and rotated, such that the end wall of the plug rotates as it moves into an abutting relationship with the sealing surface where the first and second ports are aligned with the central port and annular groove in the plug, establishing paths for fluid communication between the housing and the container.

2. The coupling arrangement of claim 1 wherein the sealing surface of the housing includes a resilient sealing member having apertures which align with the ports in the sealing surface.

3. The coupling arrangement of claim 2 wherein the resilient sealing member is held in position by a retaining element.

4. The coupling arrangement of claim 3 wherein the resilient sealing member includes means to engage the retaining element and maintain alignment of the apertures with the ports in the sealing surface of the housing.

5. The coupling arrangement of claim 2 wherein the means for engaging and advancing the container includes a pair of opposed lugs in the housing, each of the lugs being received by an arcuate channel in the neck of the container.

6. The coupling arrangement of claim 5 wherein the lugs are integral with a retaining element which also serves to hold a resilient sealing member in position.

7. The coupling arrangement comprising:

a) a housing having a sealing surface, b) first and second ports in the sealing surface of the housing, c) a fluid container having a bottom and a cylindrical neck with an open end, d) a cylindrical plug disposed in the open end of the neck of the container, an end wall of the plug having a central port and a radial port spaced from the central port, e) means for engaging and advancing the container within the housing when the container is placed in the housing and rotated, such that the end wall of the plug rotates as it moves into an abutting relationship with the sealing surface where the first and second ports are aligned with the central port and the radial port, establishing paths for fluid communication between the housing and the container, and f) the means for engaging and advancing the container within the housing includes a pair of diametrically opposite arcuate channels having vertical segments leading to downwardly sloping transverse segments and a pair of diametrically opposite lugs engaging within the arcuate channels.

8. The coupling arrangement of claim 7 wherein the fluid container is disposed in a vertical position.

9. The coupling arrangement of claim 8 wherein the fluid container is disposed in a recessed manner within a recessed housing of an extractor.

10. The coupling arrangement of claim 9 wherein the recessed housing opens to the side of the extractor for ease in operator access.

* * * * *